US009434042B2

(12) United States Patent
Chen et al.

(10) Patent No.: US 9,434,042 B2
(45) Date of Patent: Sep. 6, 2016

(54) HIGH PRECISION RIGID GAS-PERMEABLE CONTACT LENS EDGE CURVE POLISHING LATHE

(75) Inventors: Hao Chen, Zhejiang (CN); Jun Jiang, Zhejiang (CN); Doke Atsuhiro, Zhejiang (CN); Ying Shi, Zhejiang (CN); Changru Cai, Zhejiang (CN)

(73) Assignees: Wenzhou Medical University, Zhejiang (CN); Wenzhou FocuSee Vision Care Technologies Co., Ltd., Zhejiang (CN); Menicon Co., Ltd., Aichi (JP)

( * ) Notice: Subject to any disclaimer, the term of this patent is extended or adjusted under 35 U.S.C. 154(b) by 280 days.

(21) Appl. No.: 14/130,374

(22) PCT Filed: Jul. 22, 2011

(86) PCT No.: PCT/CN2011/077519

§ 371 (c)(1),
(2), (4) Date: Dec. 31, 2013

(87) PCT Pub. No.: WO2012/013374

PCT Pub. Date: Jan. 31, 2013

(65) Prior Publication Data

US 2014/0120810 A1 May 1, 2014

(51) Int. Cl.
*B24B 49/00* (2012.01)
*B24B 9/14* (2006.01)
(Continued)

(52) U.S. Cl.
CPC ..... *B24B 9/14* (2013.01); *B24B 9/142* (2013.01); *B24B 9/146* (2013.01); *B24B 13/0025* (2013.01); *B24B 27/0076* (2013.01); *B24B 49/00* (2013.01)

(58) Field of Classification Search
CPC ..... B24B 9/14; B24B 9/142; B24B 9/146; B24B 9/148; B24B 49/00; B24B 13/0025; B24B 13/005; B24B 27/0076
USPC ..... 451/9, 10, 11, 246, 255, 256, 42
See application file for complete search history.

(56) References Cited

U.S. PATENT DOCUMENTS 3,145,506 A 8/1964 Vegors et al.
3,301,105 A 1/1967 Morris
(Continued)

FOREIGN PATENT DOCUMENTS

WO 2010/049645 A1 5/2010

OTHER PUBLICATIONS

International Search Report for corresponding International Application No. PCT/CN2011/077519, mailed Apr. 26, 2012 (6 pages).

*Primary Examiner* — Eileen Morgan
(74) *Attorney, Agent, or Firm* — Osha • Liang LLP

(57) ABSTRACT

A high precision rigid gas-permeable contact lens edge curve polishing lathe includes a base provided at the bottom of a machine body. A first crank and a second crank are respectively provided on two sides of the base. A detent mechanism is provided on both the first crank and the second crank. The detent mechanism includes an ejector pin matching the rotational direction of the first crank and the second crank and a numerical display unit revealing the position of the ejector pin. The contact position of a polishing sponge on a spindle of the polishing lathe and a lens can be precisely positioned through numerical reading, realizing quantized control of the polishing of a lens edge, and enabling improvement and modification to the design of the lens edge to become simpler.

12 Claims, 1 Drawing Sheet

(51) Int. Cl.

| | |
|---|---|
| ***B24B 13/005*** | (2006.01) |
| ***B24B 13/00*** | (2006.01) |
| ***B24B 27/00*** | (2006.01) |

(56) References Cited

U.S. PATENT DOCUMENTS 3,458,959 A 8/1969 Urbach
3,528,326 A * 9/1970 Kilmer ..... B24B 9/142 29/558
4,434,581 A * 3/1984 Spriggs ..... B24B 13/0025 451/173
5,085,013 A * 2/1992 Ascosi ..... B24B 13/0025 451/384
5,347,896 A * 9/1994 Jones ..... B23B 31/02 279/2.02
5,485,771 A * 1/1996 Brennan ..... B23Q 1/0009 82/1.11
6,122,999 A 9/2000 Durazo et al.
2006/0079157 A1 4/2006 Van Brug et al.

* cited by examiner

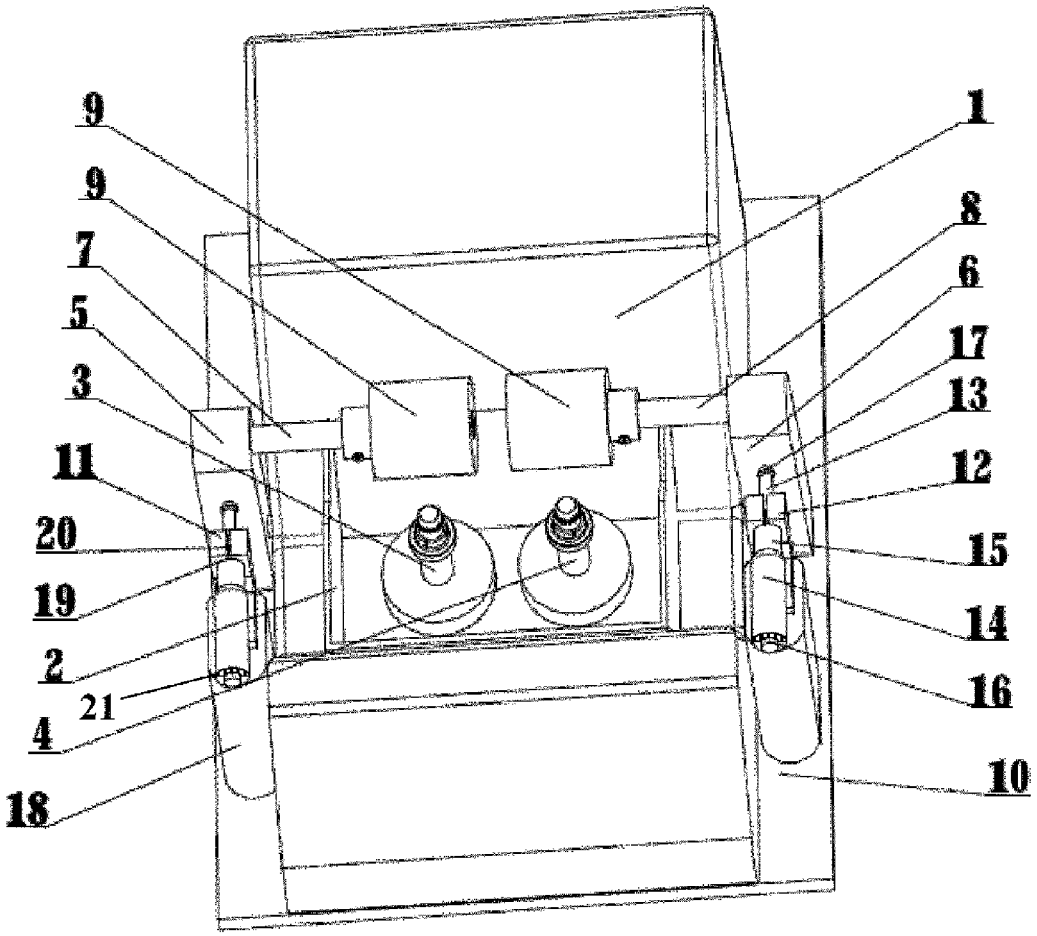
9
9
7
5
3
11
20
19
2
21
4
18
1
8
6
17
13
12
15
14
16
10

HIGH PRECISION RIGID GAS-PERMEABLE CONTACT LENS EDGE CURVE POLISHING LATHE

CROSS REFERENCE TO RELATED APPLICATIONS

This is a national stage application based on PCT/CN2011/077519, filed on Jul. 22, 2011. This application claims the priority of this prior application and incorporates its disclosure by reference in its entirety.

FIELD OF THE INVENTION

The present invention relates to a polishing equipment, and in particular, to a high precision rigid gas-permeable contact lens edge curve polishing lathe.

BACKGROUND OF THE INVENTION

A rigid gas permeable contact lens (RGP lens) is one of the most effective refractive error correction methods and appliances accepted by international optometry and ophthalmology academia and industry at present. With further development and popularization of the RGP lens, production, polishing and detection equipment related thereof are continuously updated and improved. The high precision rigid gas-permeable contact lens edge curve polishing lathe employed at present cannot imprecisely control the positioning of edge polishing, which results in the lens edge polishing position cannot be quantitatively controlled, resulting in imprecise edge polishing of the lens. The resulting lens is uncomfortable to wear, thereby affecting the lens quality.

SUMMARY OF THE INVENTION

To overcome the defects in the prior art, the present invention provides a lathe for a rigid gas permeable contact lens, which solves the problem of the existing polishing lathe in that the lens edge polishing position cannot be quantitatively controlled, resulting in reduced polishing positioning precision. Embodiments of the invention can facilitate the improvement and correction of lens edge designs to make the lens edge polishing meet the comfort requirements, thereby improving the lens qualities.

The technical solutions of the present invention are as follows: a high precision rigid gas-permeable contact lens edge curve polishing lathe comprises a machine body, wherein the upper surface of the machine body is provided with a waste liquid trough. The inside of the waste liquid trough is provided with a concave lens holder and a convex lens holder aligned in a row. The concave lens holder and the convex lens holder are capable of rotating circumferentially (i.e., around an axis). At the two sides of the machine body are, respectively, provided with a first crank and a second crank. The inside of the first crank and the inside of the second crank are, respectively, provided with a first rotating spindle and a second rotating spindle. A polishing sponge holder is provided at the front end of each spindle, and the polishing sponge holder is capable of rotating circumferentially. The first crank and the second crank rotate (roll) along the lateral surface of the machine body such that the polishing sponge holder can contact (engage) the lens held by the concave lens holder and the convex lens holder. A base is provided at the bottom of the machine body. A first support and a second support are, respectively, fixed to two sides of the base. A positioning mechanism is provided on each of the first support and the second support. The positioning mechanism comprises an abutting pin, which is aligned with the rotational direction of the first crank and the second crank, and a numerical display unit for displaying the position of the abutting pin.

The abutting pin is a measuring pole of a caliper, and the numerical display unit comprises scales on the caliper. The measuring pole passes through a fixed sleeve of the caliper and is connected with a knob. At periphery (outside) of the fixed sleeve is provided with a movable sleeve. The scales are provided on the fixed sleeve and the movable sleeve. The knob rotatably cooperates with the measuring pole, the movable sleeve and the fixed sleeve to enable the measuring pole to be adjusted back-and-forth along the lateral surface of the machine body and to actuate circumferential rotation and axial movement of the movable sleeve.

The top end of the measuring pole is provided with a ball bead, which is in contact with the first crank and the second crank.

At two sides of the base are provided with supporting arms, on which the first support and the second support are, respectively, fixed.

The first support and the second support are provided with through holes, and the measuring poles pass through the through holes and are fixed on the first support and the second support by bolts.

The ball bead is provided with a groove, and the ball bead is connected with the measuring pole via the groove.

The ball bead is made of a copper material.

The base and the supporting arms are integrally formed (i.e., a unitary piece).

Compared with the prior art, a high precision rigid gas-permeable contact lens edge curve polishing lathe of the invention has the beneficial effects as follows: the positioning mechanism of the polishing lathe has a simple mechanical structure and is convenient to use; the contact position between a polishing sponge and a lens (both mounted on a spindle of the polishing lathe) can be precisely ascertained through the numerical readings to achieve quantitative control of the polishing of a lens edge, and simplifies the improvement and modification of the design of the lens edge. Thus, lenses meeting customized designs specific to the eyes of a user and achieving optimal comfort can be produced, effectively improving product quality.

DESCRIPTIONS OF THE DRAWINGS

FIG. 1 illustrates a structure diagram of the present invention.

In FIG. 1 refers to machine body, 2 refers to waste liquid trough, 3 refers to concave lens holder, 4 refers to convex lens holder, 5 refers to first crank, 6 refers to second crank, 7 refers to first rotating spindle, 8 refers to second rotating spindle, 9 refers to polishing sponge holder, 10 refers to base, 11 refers to first support, 12 refers to second support, 13 refers to measuring pole, 14 refers to movable sleeve, 15 refers to fixed sleeve, 16 refers to knob, 17 refers to ball bead, 18 refers to supporting arm, 19 refers to through hole, 20 refers to bolt, and 21 refers to a numerical display unit.

DETAILED DESCRIPTIONS OF THE EXAMPLE EMBODIMENTS

The exemplary embodiments of the present invention will be described further with reference to FIG. 1.

As illustrated in FIG. 1, a high precision rigid gas-permeable contact lens edge curve polishing lathe comprises a machine body, wherein the upper surface of the machine body is provided with a waste liquid trough 2. The inside of the waste liquid trough 2 are provided with a concave lens holder 3 and a convex lens holder 4, which are aligned and are capable of rotating circumferentially (i.e., around an axis). The two sides of the machine body 1 are provided with a first crank 5 and a second crank 6, respectively. The inside of the first crank 5 and the inside of the second crank 6 are, respectively, provided with a first rotating spindle 7 and a second rotating spindle 8, which are each provided with a polishing sponge holder 9 at the end of the rotating spindle and are capable of rotating circumferentially. The first crank 5 and the second crank 6 rotate along the lateral sides of the machine body 1 such that the polishing sponge holder 9 cooperates with (engages) a concave lens held on the concave lens holder 3 and a convex lens held on the convex lens holder 4. A base 10 is provided at the bottom of the machine body 1. A first support 11 and a second support 12 are provided at two sides of the base 10. The first support 11 and the second support 12 are each provided with a positioning mechanism. The positioning mechanism comprises an abutting pin matching the rotational direction of the first crank 5 and the second crank 6, and a numerical display unit 21 displays the position of the abutting pin. According to the above embodiment, the positioning mechanism of the polishing lathe has a simple mechanical structure and is convenient to use. The contact position of a polishing sponge on a spindle of the polishing lathe and a lens can be precisely controlled using the numerical display to realize quantitative control of the polishing of a lens edge, thereby simplifying the improvement and modification of the lens edge design. Thus, it becomes possible to make lenses conforming to the eyes of a person and achieving optimal comfort, effectively improving product quality.

As illustrated in FIG. 1, the abutting pin is a measuring pole 13 of a caliper, and the numerical display unit comprises scales on the caliper. The measuring pole 13 passes through a fixed sleeve 15 of the caliper and is connected with a knob 16. A movable sleeve 14 surrounds the fixed sleeve 15. The scales are provided on the fixed sleeve 15 and the movable sleeve 14. The knob 16 can rotate and coordinate with the measuring pole 13, the movable sleeve 14, and the fixed sleeve 15 to enable the measuring pole 13 to be adjustable back and forth along the side of the machine body 1, resulting in the circumferential rotation and axial movement of the movable sleeve 14. The measuring pole 13, the movable sleeve 14, the fixed sleeve 15, and the knob 16 are components of the caliper. The caliper has high precision, a distance between the polishing sponge holder 9 and the lens edges can be positioned accurately and effectively. An optimal polishing position between the polishing sponge holder 9 and the lens edges held on the concave lens holder 3 or the convex lens holder 4 may be obtained after several trials, based on the positions of the cranks, the concave lens holder 3 and the convex lens holder 4 on the polishing lathe. Thus, a lens with optimal comfort level can be produced. The beneficial effects of the lens are significantly improved relative to that of the existing polishing equipment.

As illustrated in FIG. 1, the top end of the measuring pole 13 is provided with a ball bead 17, which is in contact with the first crank 5 and the second crank 6. The ball bead 17 is made of a copper material and easy to process. Alternatively, other metal materials such as stainless steel can also be used. Including the ball bead 17 on the head of the measuring pole 13 can effectively improve the positioning precision. The cranks can be actuated by finely tuning the knob 16 so as to realize the locating precision between the polishing sponge holder 9 and the lens edges. The ball bead 17 is provided with a groove, which is used to connect the ball bead 17 with the measuring pole 13 such that the ball bead 17 is firmly connected with the measuring pole 13 to improve the stability.

As illustrated in FIG. 1, supporting arms 18 are provided on two sides of the base 10. The first support 11 and the second support 12 are respectively fixed on the supporting arms. The base 10 and the supporting arms 18 may be integrally molded. The supporting arms 18 are arranged at the two sides of the base 10. The first support 11 and the second support 12 are fixed on the supporting arms 18 via bolts 20. The first support 11 and the second support 12 are provided with through holes 19. The measuring pole 13 passes through the through holes 19 and is fixed on the first support 11 or the second support 12 by a the bolt 20 to coordinate with the crank.

These embodiments shall not be considered as limiting the scope of the present invention. Any improvement made based on the spirit of the present invention shall fall within the protection scope of the present invention.

What is claimed is:

1. A high precision rigid gas-permeable contact lens edge curve polishing lathe, comprising:

a machine body;

a waste liquid trough provided on an upper surface of the machine body;

a concave lens holder and a convex lens holder provided in parallel inside the waste liquid trough, wherein the concave lens holder and the convex lens holder are capable of rotating circumferentially;

a first crank and a second crank respectively disposed on a base of the machine body at two sides of the machine body;

a first rotating spindle and a second rotating spindle respectively provided inside the first crank and the second crank, wherein a polishing sponge holder provided at an end of each of the first rotating spindle and the second rotating spindle, wherein the polishing sponge holder is capable of rotating circumferentially, and wherein the first crank and the second crank can rotate along a lateral surface of the machine body to enable the polishing sponge holder to engage a lens held on the concave lens holder or a lens held on the convex lens holder; and a positioning mechanism provided on each of the first crank and the second crank, wherein the positioning mechanism comprises an abutting pin, aligned in a rotational direction of the first crank or the second crank, and a numerical display unit for displaying a position of the abutting pin.

2. The high precision rigid gas-permeable contact lens edge curve polishing lathe of claim 1, wherein the abutting pin is a measuring pole of a caliper; the numerical display unit is a scale on the caliper; the measuring pole passes through a fixed sleeve of the caliper and is connected with a knob; a periphery of the fixed sleeve is provided with a movable sleeve; the scale is provided on the fixed sleeve and the movable sleeve; the knob rotatably coordinates with the measuring pole, the movable sleeve and the fixed sleeve to enable the measuring pole to adjust back-and-forth along the lateral surface of the machine body and to actuate circumferential rotation and axial movement of the movable sleeve.

3. The high precision rigid gas-permeable contact lens edge curve polishing lathe of claim 2, wherein an end of the measuring pole is provided with a ball bead, which is in contact with the first crank or the second crank.

4. The high precision rigid gas-permeable contact lens edge curve polishing lathe of claim 1, wherein two supporting arms are provided on two sides of the base and the first crank and the second crank are respectively fixed on the two supporting arms.

5. The high precision rigid gas-permeable contact lens edge curve polishing lathe of claim 1, wherein the first crank and the second crank are each provided with a through hole; wherein the abutting pin is a measuring pole, which passes through the through hole and is fixed on the first crank or the second crank.

6. The high precision rigid gas-permeable contact lens edge curve polishing lathe of claim 3, wherein the ball bead is provided with a groove, and the ball bead is connected with the measuring pole via the groove.

7. The high precision rigid gas-permeable contact lens edge curve polishing lathe of claim 3, wherein the ball bead is made of a copper material.

8. The high precision rigid gas-permeable contact lens edge curve polishing lathe of claim 4, wherein the base and the supporting arms form an integral piece.

9. The high precision rigid gas-permeable contact lens edge curve polishing lathe of claim 2, wherein two supporting arms are provided on two sides of the base and the first crank and the second crank are respectively fixed on the two supporting arms.

10. The high precision rigid gas-permeable contact lens edge curve polishing lathe of claim 3, wherein two supporting arms are provided on two sides of the base and the first crank and the second crank are respectively fixed on the two supporting arms.

11. The high precision rigid gas-permeable contact lens edge curve polishing lathe of claim 2, wherein the first crank and the second crank are each provided with a through hole; the measuring pole passes through the through hole and is fixed on the first crank or the second crank.

12. The high precision rigid gas-permeable contact lens edge curve polishing lathe of claim 3, wherein the first crank and the second crank are each provided with a through hole; the measuring pole passes through the through hole and is fixed on the first crank or the second crank.

* * * * *